United States Patent [19]

Campbell

[11] 4,434,453

[45] Feb. 28, 1984

[54] GLARE-ELIMINATING TASK LIGHTING FIXTURE

[76] Inventor: James Campbell, 50 Grove Street Extension, Sewickley, Pa. 15143

[21] Appl. No.: 384,651

[22] Filed: Jun. 1, 1982

[51] Int. Cl.[3] ..... A61G 13/00

[52] U.S. Cl. ..... 362/33; 362/145; 362/147; 362/217; 362/225; 362/249; 362/296

[58] Field of Search ..... 362/33, 145, 147, 217, 362/225, 249, 296

[56] References Cited

U.S. PATENT DOCUMENTS

| | | | |
|---|---|---|---|
| 1,249,500 | 12/1917 | Richter . | |
| 1,587,375 | 6/1926 | Gignac . | |
| 1,680,062 | 8/1928 | Newton . | |
| 1,969,306 | 8/1934 | Hunter | 240/2.17 |
| 1,997,585 | 4/1935 | Hunter | 45/6 |
| 2,845,322 | 7/1958 | Squindo | 312/233 |
| 2,939,755 | 6/1960 | Wyant | 312/245 |
| 3,350,150 | 10/1967 | Schwarm | 312/117 |
| 3,389,246 | 6/1968 | Shemitz | 240/2 |
| 3,700,877 | 10/1972 | Wilson | 240/3 |
| 3,980,361 | 9/1976 | Shaw et al. | 312/223 |
| 4,054,793 | 10/1977 | Shemitz | 362/127 |
| 4,058,718 | 11/1977 | Palka | 362/235 |
| 4,300,185 | 11/1981 | Wakamatsu | 362/223 |

*Primary Examiner*—Stephen J. Lechert, Jr.

*Attorney, Agent, or Firm*—Buell, Blenko, Ziesenheim & Beck

[57] ABSTRACT

A task lighting assembly having a task lighting fixture secured in overlying relationship with respect to a work station, a building wall member disposed adjacent to the lighting fixture and adjacent to the work station and the lighting fixture having an upper wall, a front wall depending from the upper wall and an inwardly projecting lower wall projecting from the front wall. At least one light source receiving recess is defined between the walls. A light discharging opening is disposed between the lower wall and the building wall member. The lower wall is of sufficient length so that no significant portion of the light emitted by a light source in the recess will travel directly downwardly to illuminate the work station. The fixture preferably has no lens. The work station is illuminated primarily through reflected radiation. The undersurface of the upper wall preferably has a reflectance of at least about 80 percent. A task lighting fixture suitable for use in the above-described assembly.

19 Claims, 7 Drawing Figures

GLARE-ELIMINATING TASK LIGHTING FIXTURE

BACKGROUND OF THE INVENTION

1. Field of the Invention

The present invention relates to glare and veiling reflection eliminating task lighting fixtures and, more specifically, such fixtures which provide uniform, indirect lighting without requiring the use of a lens.

2. Description of the Prior Art

Various means have been known to provide lighting through use of a fixture which contains an area for receiving a light source and has a portion of its housing adapted to reflect light emanating from the light source so as to establish illumination of a desired region, at least partially, through indirect rays. See, for example, the vehicle fixture disclosed in U.S. Pat. No. 1,587,375. Another outdoor use is shown in U.S. Pat. No. 3,700,877. See also U.S. Pat. No. 1,249,500. Various sorts of shrouds adapted to provide at least some reflected illumination and capable of being used indoors have also been known. See U.S. Pat. Nos. 1,680,062; 2,939,755; 3,350,150; 3,980,361 and 4,058,718.

It has been known to provide desklike constructions having overhead hoods which provide shielded, direct illumination along with some reflected illumination to underlying desk surfaces. See U.S. Pat. Nos. 1,969,306; 1,997,585 and 2,845,322. U.S. Pat. No. 4,054,793 employs lenses as a means for minimizing undesired glare and veiling reflections on work surfaces including surfaces underlying shelflike members.

U.S. Pat. No. 3,389,246 discloses partition constructions which are adapted to illuminate adjacent areas through a portion of the light being received indirectly off of the ceiling and another portion being directed downwardly. One embodiment contemplates downwardly reflected lighting in addition to the upward, indirect lighting.

In spite of the teachings of these patents, there remains a need for an efficient source of indirect lighting which will resist undesired glare and veiling reflections such as occur when light travels directly from the light source to the work station and is reflected from the work station surface to the user's eyes. There is also lacking such a system which can accomplish these objectives through indirect lighting, without requiring the use of lenses.

SUMMARY OF THE INVENTION

The present invention has solved the above-described problems by providing a task lighting fixture assembly and the associated fixture wherein illumination is provided substantially completely through indirect lighting which resists undesired glare and veiling reflections, while not requiring the use of lenses.

In a preferred form of lighting fixture of the present invention, a substantially light-opaque upper wall cooperates with a front wall depending therefrom and a reentrant lower wall which projects inwardly sufficiently far as to cooperate with the other walls in defining a light source receiving recess and in resisting passage of direct lighting to the underlying work surface. Light will impinge upon the underlying work surface as a result of reflection from the lighting fixture or the building wall portion disposed adjacent the lighting fixture or both.

In a preferred use the lighting fixture may be positioned underlying a cabinet or shelflike member.

It is an object of the present invention to provide an efficient and economical task lighting fixture which will provide substantially all of the illumination in the form of indirect lighting.

It is a further object of the present invention to provide such a lighting fixture wherein the use of a lens is not required.

It is another object of the present invention to provide such a lighting fixture which is aesthetically pleasing, and resists creation of undesired glare as well as veiling reflections.

It is yet another object of the present invention to provide such a lighting fixture which, in one embodiment, functions both as a lighting fixture and as a shelf member.

These and other objects of the invention will be more fully understood from the following description of the invention on reference to the illustrations appended hereto.

DESCRIPTION OF THE PREFERRED EMBODIMENTS

While the present invention permits the advantageous use of a lighting fixture which does not require the presence of a lens, if desired, one may provide dust covers or other physical structures which might slightly alter the direction or intensity of the light. Such systems are contemplated herein and will be deemed to be systems without a lens. As used herein, the term "lens" shall refer to a translucent physical element through which light created by a light source disposed within a lighting fixture will pass without the element effecting substantial alteration of direction or intensity of the light or effecting substantial distortion of the same.

Figure 1:
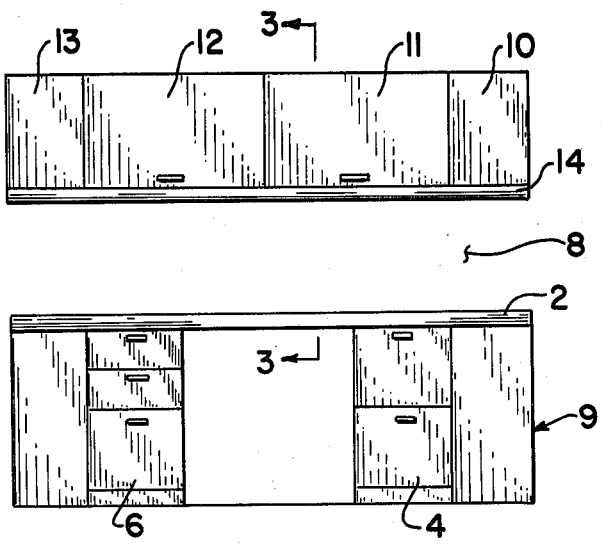
FIG. 1 is a front elevational view of a task lighting assembly of one embodiment of the present invention.
Figure 2:
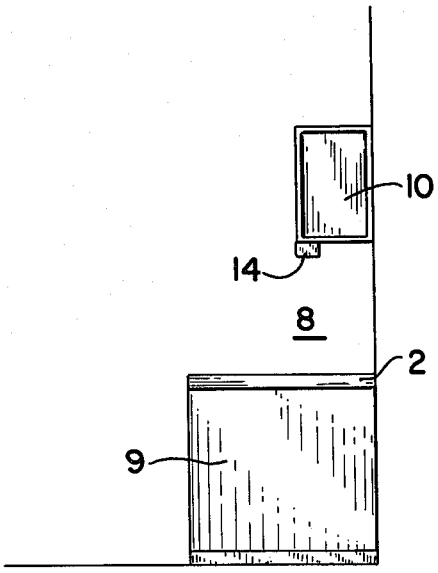
FIG. 2 is a right elevational view of the embodiment of FIG. 1.

Referring now in greater detail to FIGS. 1 and 2, there is shown an elevational view of a form of lighting fixture assembly of the present invention. In the form shown, the task lighting assembly is adapted to be employed as a source of indirect task lighting in connection with a counterlike work surface or desk 2. In this embodiment the lighting may be employed in an office, kitchen, or workshop environment, for example. The work surface 2 is secured in overlying relationship with respect to cabinetry 9 which includes a first series of drawers 4 and a second series of drawers 6. Cabinets 10, 11, 12, 13 are separated from the counterlike work surface 2 by a space 8. The lighting fixture 14 is secured to the undersurface of the cabinets 10–13 and directs the lighting through reflection or indirectly to the surface 2 on which the work will be performed.

Figure 3:
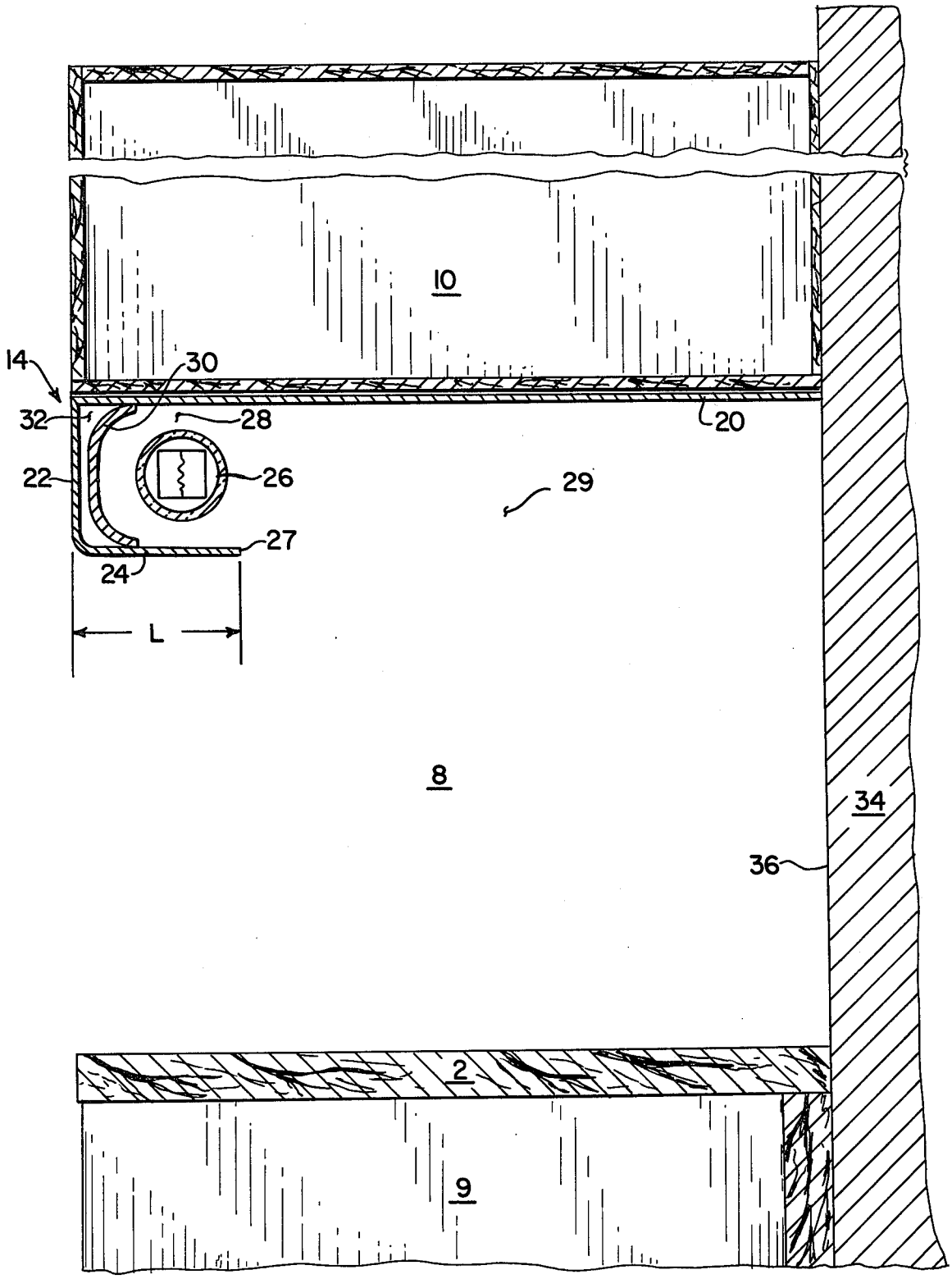
FIG. 3 is a cross-sectional view of a portion of the embodiment shown in FIG. 1 taken through 3—3.

Referring now to FIG. 3, a detail of the lighting arrangement will now be considered. In this assembly, the lighting fixture 14 is secured by any conventional means (not shown) such as screws, for example, to the undersurface of the cabinets 10–13. The lighting fixture has an upper wall 20, a front wall 22 which depends from the upper wall 20 and an inwardly projecting lower wall 24 which projects inwardly from front wall 22 a distance "L". The walls 20, 22, 24 cooperate to define a light-source receiving recess 28 which, in the form shown, contains an elongated fluorescent lamp 26. The length L of the inward projection of the lower wall 24 is preferably such that the free end 27 thereof extends farther inwardly than the innermost portion of the lamp 26. In this fashion, light emitted by lamp 26 will impinge upon work surface 2 substantially completely in the form of reflected light as distinguished from direct illumination. In general, light will reflect out of the undersurface of upper wall 20 or the surface 36 of building wall member 34 as distinguished from substantial quantities of light reaching the work surface 2 directly. It is also noted that the opening 29 defined between the end 27 of lower wall 24 and building wall portion 34 contains no lens. The building wall portion may consist of a full wall which extends to the ceiling or partitions or panels which extend only part way to the ceiling or combinations of both.

In a preferred embodiment of the invention the lower surface of upper wall 20 will have a reflectance of at least 80%. The building wall surface will preferably have a reflectance of at least 50%.

Referring still to FIG. 3, there is shown a reflector member 30 which is positioned within recess 28 and in spaced relationship with respect to front wall 22. This reflector 30 not only serves to reflect light from light source 26, but also serves to cooperate with walls 20, 22, 24 to define a wireway 32 which permits passage of electrical wires (not shown) to energize the light source. An electrical switch (not shown) may be positioned at any convenient location, as by securement to lower wall, for example. It will be appreciated, therefore, that the present lighting provides efficient task lighting to work surface 2 by indirect rays which resist undesired glare and veiling reflections without requiring the presence of lenses. It will be appreciated that while the walls 20, 22, 24 have been shown as distinct segments, these members are advantageously formed out of a unitary piece of material and the merger of the wall portions may be more curved so as to make the distinct wall segments less perceptible, if desired.

Figure 4:
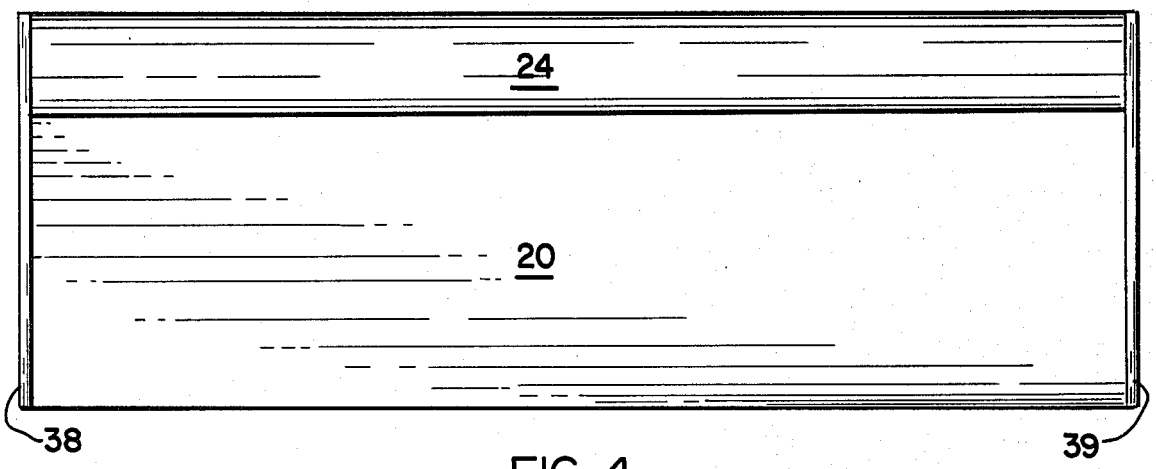
FIG. 4 is a bottom plan view of the lighting fixture of FIG. 1.

As is shown in FIG. 4, a pair of end walls 38, 39 have been provided at either end of the fixture so as to resist undesired loss of light through either end. The fixture may be made in any desired length and may generally be employed with other such fixtures disposed in end-to-end relative relationship.

Figure 5:
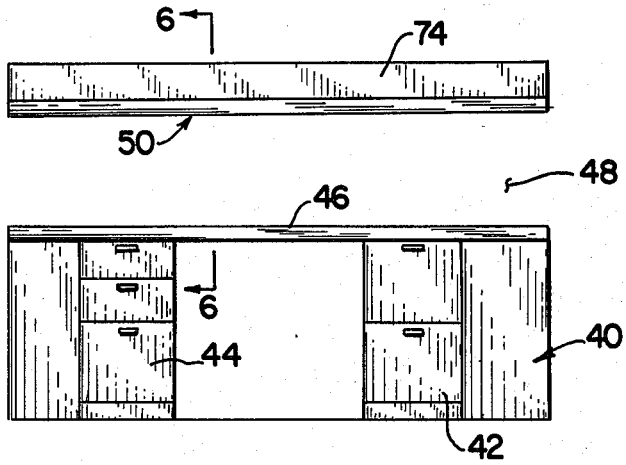
FIG. 5 is a front elevational view of a task lighting assembly of another embodiment of the present invention.
Figure 6:
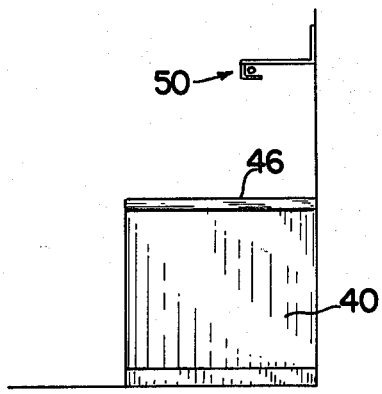
FIG. 6 is a cross-sectional view of the embodiment of FIG. 5 taken through 6—6.
Figure 7:
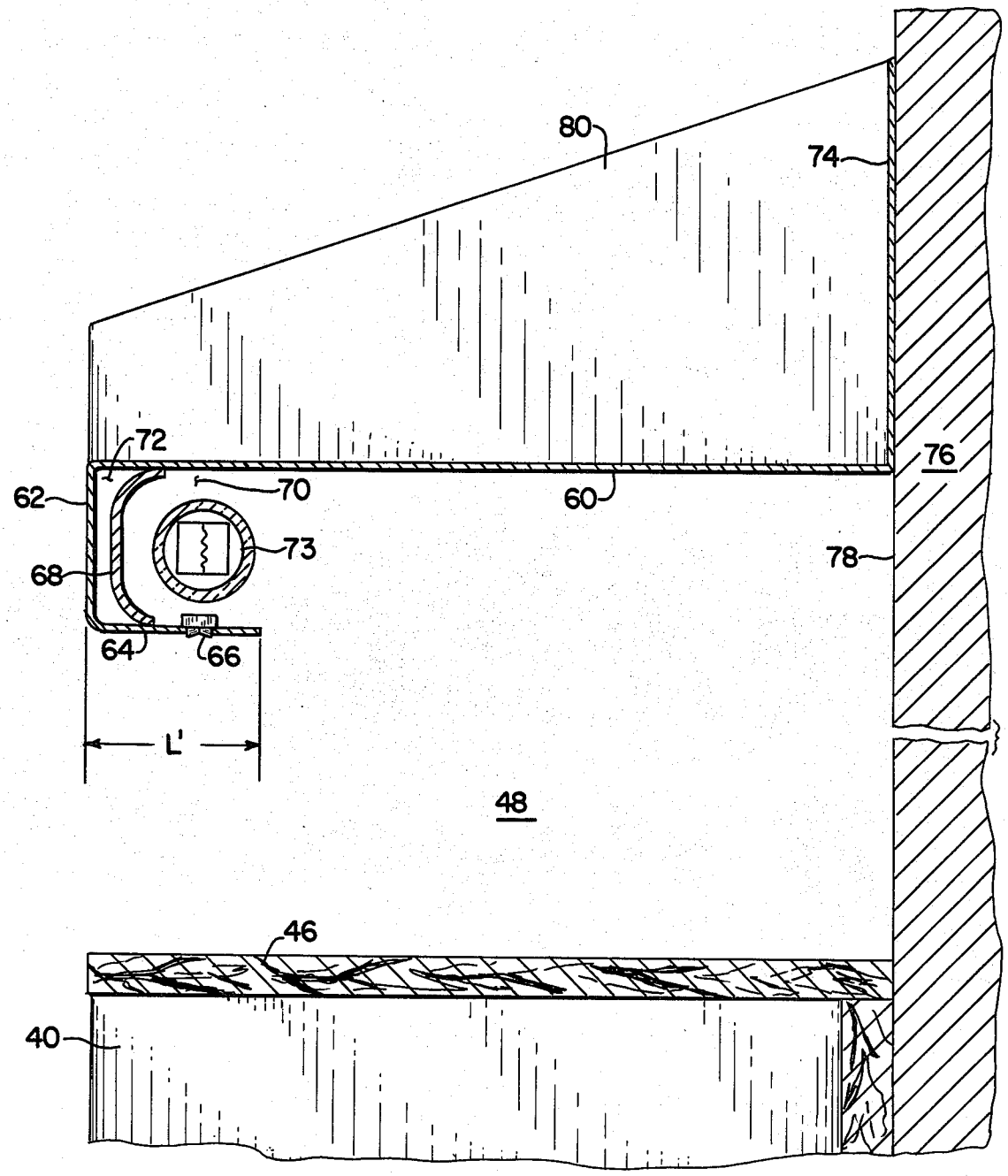
FIG. 7 is a detail of a portion of the right side elevational view shown in FIG. 5.

Referring now to FIGS. 5 through 7, another embodiment of the invention will be considered. In this embodiment of the invention, a work surface 46 is disposed on a group of cabinets or desk 40 which include drawers 42, 44. Overlying lighting fixture 50 is disposed above space 48 which separates the work surface 46 from the lighting fixture 50.

Referring now to FIG. 7, it will be noted that the lighting fixture functions both as a shelf member and as a lighting fixture. More specifically, the lighting fixture has an upper wall 60, a front wall 62 and an inwardly projecting lower wall 64 which contains an electrical switch 66. An interior reflector 68 cooperates with other portions of the fixture to define wireway 72. Disposed within light source receiving recess 70 is an elongated fluorescent lamp 73 which does not project as far inwardly (L) as the free end of lower wall 64. Projecting upwardly from the innermost portion of upper wall 60 is a flange member 74 through which fasteners (not shown) may be passed in securing the lighting fixture to the building wall portion 76. End walls 80 may be positioned at either end of the generally L-shaped configuration defined by upper wall 60 and flange 74. In this fashion, a single unit may function both as a shelf and as a lighting fixture as contemplated by the present invention. Light will be reflected off of building wall portion surface 78 or off of upper wall 60 and other portions of the lighting fixture to provide indirect illumination of the work surface 46.

If desired, a downwardly-depending flange (not shown) may be provided at or adjacent the innermost portion of upper wall 60 in lieu of or in addition to flange 74. Finally, while the flange 74 will generally be substantially continuous along the length of the lighting fixture, flanges in the forms of individual, integrally formed straplike members or other integrally formed means for supporting the upper wall 60 may be provided, if desired.

It will be appreciated, therefore, that the present invention has provided an efficient task lighting system wherein substantially all of the illumination provided by the lighting fixture to the underlying work surface is indirect lighting. All of this is accomplished in an economical and simple fashion without requiring the use of lenses.

While for convenience of illustration reference has been made to the use of fluorescent lamps, it will be appreciated that incandescent lamps as well as other sources of lights may advantageously be employed in the lighting fixture of this invention, should the same be so desired. If desired, when incandescent lamps or similarly configurated lamps are employed the lower wall 24, 64 may be discontinuous. The lateral edges of such sections may be deformed upwardly so as to partially surround each lamp, define a number of light source receiving recesses and enhance the shielding action which resists direct illumination of the work surface. Also, in either the continuous or discontinuous form the inner portion of wall 24, 64 may be deformed upwardly.

Whereas particular embodiments of the invention have been described above for purposes of illustration, it will be appreciated by those skilled in the art that numerous variations of the details may be made without departing from the invention as described in the appended claims.

I claim:

1. A task lighting fixture comprising a substantially light opaque upper wall, a front wall depending from said upper wall, a re-entrant, lower wall projecting generally inwardly from said front wall in spaced underlying relationship with respect to said upper wall, at least one light source receiving recess defined between said walls, and said lower wall being of sufficient length that when said fixture is hung with said lower wall in a generally horizontal position, no significant portion of the light emitted by a light source disposed in said recess is projected directly downwardly to a work station underlying said fixture.

2. The task lighting fixture of claim 1 including the undersurface of said upper wall having a reflectance of at least about eighty percent.

3. The task lighting fixture of claim 2 including the innermost edge of said lower wall projecting farther inwardly than the innermost portion of said light source.

4. The task lighting fixture of claim 3 including a flange member projecting from a rear portion of said upper wall.

5. The task lighting fixture of claim 3 including said fixture adapted to receive a fluorescent light source within said light source receiving recess.

6. The task lighting fixture of claim 3 including reflector means disposed within said light source-securing recess in spaced relationship with respect to said front wall, and a wireway defined between said reflector means and said first wall.

7. The task lighting fixture of claim 3 including said lighting fixture having no lens.

8. The task lighting fixture of claim 4 including the upper surface of said upper wall adapted to function as a shelf when said flange is secured to a wall.

9. A task lighting assembly comprising a task lighting fixture secured in overlying relationship with respect to a work station, a building wall member disposed adjacent said lighting fixture and adjacent said work station, said lighting fixture having an upper wall, a front wall depending from said upper wall and an inwardly projecting lower wall projecting from said front wall, at least one light source receiving recess defind between said walls, a light discharging opening between said lower wall and said building wall member, and said lower wall being of sufficient length that no significant portion of the light emitted by a light source in said recess will project directly downwardly to illuminate said work station.

10. The task lighting assembly of claim 9 including said work station having a generally horizontally disposed counterlike surface.

11. The task lighting assembly of claim 10 including said lighting fixture having no lens.

12. The task lighting assembly of claim 11 including said building wall surface having a reflectance of at least about fifty percent.

13. The task lighting assembly of claim 11 including the undersurface of said upper wall having a reflectance of at least eighty percent, whereby substantially all the light impinging on said work station will be reflected from said upper wall and said building wall portion.

14. The task lighting assembly of claim 9 including the innermost edge of said lower wall projecting farther inwardly than the innermost portion of said light source.

15. The task lighting assembly of claim 4 including a flange member projecting from a rear portion of said upper wall.

16. The task lighting assembly of claim 5 including the upper surface of said upper wall adapted to function as a shelf when said flange is secured to said building wall surface.

17. The task lighting assembly of claim 6 including said fixture adapted to receive a fluorescent light source within said light source receiving recess.

18. The task lighting assembly of claim 7 including reflector means disposed within said light source receiving recess in spaced relationship with respect to said front wall, and a wireway defined between said reflector and said first wall.

19. The task lighting assembly of claim 8 including said lighting fixture having no lens.

* * * * *